US007263737B1

(12) United States Patent
Walsh et al.

(10) Patent No.: US 7,263,737 B1
(45) Date of Patent: Sep. 4, 2007

(54) PIPE CLEANER

(76) Inventors: Richard T. Walsh, 43 Knob Hill Rd., Glastonbury, CT (US) 06033; Richard T. Walsh, Jr., 32 Keighley Pond Rd., Middle Haddam, CT (US) 06456

( * ) Notice: Subject to any disclaimer, the term of this patent is extended or adjusted under 35 U.S.C. 154(b) by 0 days.

(21) Appl. No.: 11/431,359

(22) Filed: May 10, 2006

(51) Int. Cl.
*B08B 1/00* (2006.01)

(52) U.S. Cl. ..... 15/104.04; 15/88

(58) Field of Classification Search ..... None
See application file for complete search history.

(56) References Cited

U.S. PATENT DOCUMENTS

| | | | | |
|---|---|---|---|---|
| 2,455,762 | A | 12/1948 | Hall | |
| 2,537,916 | A | 1/1951 | Rosenboom | |
| 2,838,778 | A | 6/1958 | Von Arx | |
| 3,076,988 | A | 2/1963 | Mills | |
| 3,436,783 | A | 4/1969 | McCartney | |
| 4,166,301 | A | 9/1979 | Smith | |
| 4,274,770 | A | 6/1981 | Singer | |
| 4,372,003 | A | 2/1983 | Toelke | |
| 4,433,448 | A | 2/1984 | True | |
| 4,600,444 | A | 7/1986 | Miner | |
| 5,168,660 | A * | 12/1992 | Smith | 451/462 |
| 6,101,696 | A | 8/2000 | Carter | |
| 6,106,370 | A | 8/2000 | Carter | |
| 6,497,022 | B1 | 12/2002 | Carter | |
| 6,704,964 | B2 | 3/2004 | Knowles | |
| 6,745,425 | B1 | 6/2004 | Tope | |
| 6,745,426 | B1 | 6/2004 | Knowles | |

* cited by examiner

*Primary Examiner*—David Redding
(74) *Attorney, Agent, or Firm*—Ira S. Dorman

(57) ABSTRACT

A tool for simultaneously cleaning inside and outside surfaces surrounding an open end portion of a pipe includes a cleaning arm and a pipe-supporting arm mounted in a head for adjustment of the transverse spacing therebetween. Support portions on the cleaning arm have confronting faces spaced transversely from one another and defining a rearwardly extending, forwardly open slot adapted for the receipt of the wall of a pipe supported on the pipe-supporting arm, and a pipe-cleaning element is disposed on each of the confronting faces of the support portions. Relative rotation of the mounting head and a pipe so positioned will cause the cleaning elements to effect simultaneous cleaning of the surrounding inside and outside surfaces of the pipe end portion.

19 Claims, 2 Drawing Sheets

PIPE CLEANER

BACKGROUND OF THE INVENTION

It is well known in the art that, during installation, end portions of pipes, tubing, and like conduits, such as are usually made of copper, aluminum or plastic and are used for the containment of electrical wires or for carrying water, heating or cooling gases, and other fluids, must be cleaned on the inside and outside so as to facilitate the introduction of wires and to ensure sound assembly with fittings, couplings, and the like. Surfaces that are sharp, rough, contaminated or oxidized can inhibit soldering, brazing, and bonding, resulting in joints that are unsound and porous; slivers of material, burrs and sharp edges can also injure workers and can damage wire used in constructing an electrical installation.

A pipe cleaning system that is capable of simultaneously cleaning the interior and exterior of the open end portion of a copper pipe is disclosed in Knowles U.S. Pat. Nos. 6,704,964 and 6,745,426. Additional United States patents of interest in the field include Hall U.S. Pat. No. 2,455,762, Rosenboom U.S. Pat. No. 2,537,916, Von Arx U.S. Pat. No. 2,838,778, Mills U.S. Pat. No. 3,076,988, McCartney U.S. Pat. No. 3,436,783, Smith U.S. Pat. No. 4,166,301, Singer U.S. Pat. No. 4,274,770, Toelke U.S. Pat. No. 4,372,003, True U.S. Pat. No. 4,433,448, Miner U.S. Pat. No. 4,600,444, Carter U.S. Pat. No. 6,101,696, Carter U.S. Pat. No. 6,106,370, Carter U.S. Pat. No. 6,497,022 and Tope U.S. Pat. No. 6,745,425.

Despite the activity in the art indicated by the foregoing, the need remains for a tool that is effective for simultaneously cleaning inside and outside surfaces surrounding an open end portion of pipes and other tubular conduits of various sizes throughout a range of diameters.

SUMMARY OF THE INVENTION

Accordingly, it is a broad object of the present invention to provide a tool for simultaneously cleaning inside and outside surfaces surrounding an open end portion of a pipe or other tubular conduit, which tool is adjustable so as to enable its use for conduits of various sizes.

It is a more specific object of the invention to provide such an adjustable tool that is constructed for manual use.

It is another more specific object of the invention to provide such an adjustable tool that is constructed for semi-automatic use.

It is a further more specific object of the invention to provide such an adjustable tool that is constructed for fully automatic use.

Yet another more specific object of the invention is to provide a tool having the foregoing features and advantages, which tool is constructed to also enable simultaneous cleaning of the end surface of a pipe.

It should be appreciated that, as a convenience, all forms of tubular conduits of at least substantially circular cross section are intended to be encompassed by references herein to "pipe," irrespective of the size or character of the conduit or of the material from which it is fabricated.

It has now been found that certain of the foregoing and related objects of the invention are attained by the provision of a tool for simultaneously cleaning inside and outside surfaces surrounding an open end portion of a pipe, which tool comprises a mounting head having at least one cleaning arm and at least one pipe-supporting arm, the latter being constructed to supportingly engage, from the outside, an end portion of a pipe. The cleaning arm has inner and outer support portions, which extend forwardly with respect to the mounting head and have confronting faces thereon that are spaced transversely from one another and define a rearwardly extending, forwardly open slot therebetween; each confronting face carries a pipe-cleaning element, which will usually be removably attached. Means is provided on the mounting head for mounting the cleaning arm and the pipe-supporting arm so as to extend forwardly, with respect to the head, in transversely spaced relationship to one another and in position to enable receipt, within the slot between the forwardly extending support portions of the cleaning arm, of the wall defining the open end portion of a pipe that is engaged and supported by the supporting arm; the means for mounting enables adjustment of the transverse spacing between the cleaning arm and the pipe-supporting arm. Relative rotation of the mounting head and a pipe that is so engaged, supported and received, about the axis of the pipe end portion, will cause the pipe-cleaning elements to effect cleaning simultaneously of the surrounding inside and outside pipe surfaces.

The means for mounting will, more particularly, usually comprise a rectilinear positioning screw that is mounted transversely in the mounting head for rotation about its axis. Either the cleaning arm or the pipe-supporting arm (and normally both) is formed with a threaded transverse passage though which the positioning screw extends, which passage engages a correspondingly threaded section of the positioning screw. As long as one of the arms is effectively fixed, or both arms are threadably engaged as hereinafter described, rotation of the positioning screw will effect adjustment of the transverse spacing between the cleaning arm and the pipe-supporting arm so as to accommodate pipes throughout a range of diameters.

As indicated, the positioning screw will normally (and most preferably) have a second threaded section with a thread direction that is opposite to the thread direction of a first threaded section, with both the cleaning arm and also the pipe-supporting having corresponding threaded passages for mating engagement with the positioning screw. Such an arrangement will of course cause the cleaning arm and the pipe-supporting arm to move simultaneously, in opposite directions, upon rotation of the positioning screw.

The mounting head of the tool will normally be generally circular, with the positioning screw extending diametrically thereacross. A rectilinear guide shaft will advantageously also be provided, mounted transversely in the mounting head and parallel to and rearwardly of the positioning screw so as to extend through transverse passages in the inner end portions of the cleaning arm and the pipe-supporting arm, and thereby slideably support them thereon. The pipe-cleaning elements employed will usually be brushes, albeit other suitable cleaning elements, evident to those skilled in the art, may also be utilized if so desired.

At least the inner support portion of the cleaning arm will advantageously have a widest dimension that is not in excess of about one-half inch, so as to facilitate insertion into pipes of small diameter (e.g., pipes having an inside diameter of one inch or less) and minimize interference with relative rotation. Means will desirably be provided for biasing the pipe-cleaning element on the inner support portion of the cleaning arm toward the outer support portion, so as to promote intimate contact and better accommodate surface and structural irregulations or variations in the pipe (e.g., out-of-roundness), and a small metal file strip or fillet, or other element that is effective for abrading the end of a pipe, may advantageously be disposed on a support surface at the rearward end of the slot in the cleaning arm.

Low-friction means (e.g., one or two rollers, or a pad of tough plastic resin) may be provided on the pipe-supporting arm for engaging the pipe end portion. A stop element may also be provided thereon, positioned to engage the surface on the end of a supported pipe so as to thereby limit the depth to which the pipe can be inserted into the mounting head.

The tool of the invention may be constructed for manual, semi-automatic, or fully automatic use. In the first two instances the tool will include means for turning the arm-adjusting positioning screw manually. A semi-automatic or fully automatic embodiment of the invention will include a drive shaft operatively connected to the mounting head and constructed for operative engagement with drive means for effecting rotation of the tool. To fully automate the tool, the drive shaft will also be operatively connected for effecting rotation of the positioning screw within the mounting head so as to initially cause the cleaning arm and the pipe-supporting arm to advance toward one another. Such preliminary closing action (i.e., produced prior to substantial rotation of the tool) may result either from the inertia of the tool itself or from the application of an external braking or retarding force.

DETAILED DESCRIPTION OF THE PREFERRED AND ILLUSTRATED EMBODIMENTS

Figure 1:
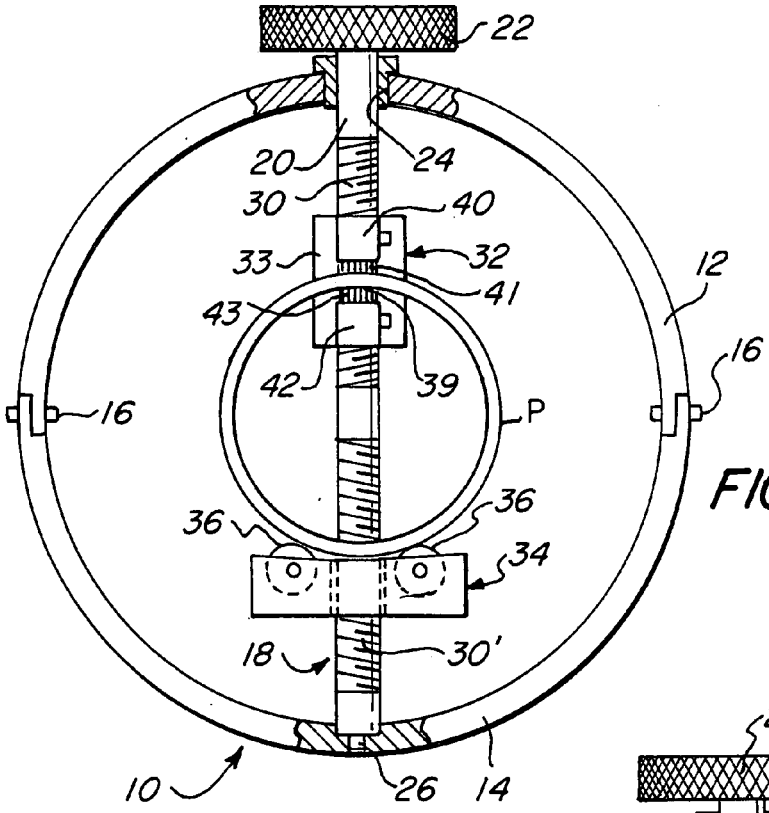
FIG. 1 is an end view showing a tool embodying the present invention, constructed for manual use.

Turning initially to FIG. 1 of the drawings, therein illustrated is a cleaning tool embodying the present invention and consisting of a head, generally designated by the numeral 10, comprised of two semi-circular collar sections 12, 14 which are interengaged and joined to one another by fasteners 16 to thereby form a full circular collar. A rectilinear positioning screw has a shaft, generally designated by the numeral 18, which extends diametrically across the collar of the head 10, with a proximal plain portion 20, adjacent a knurled operating knob 22, passing through a round hole 24 in the collar section 12 and with a distal small-diameter tip element 26 rotatably received in a mating socket 28 formed into the opposite collar section 14. The positioning screw has threaded portions, 30, 30' intermediate its ends, the threads of which are directed oppositely to one another (i.e., a right-hand thread and a left-had thread).

The tool includes a cleaning arm, generally designated by the numeral 32, and a pipe-supporting arm generally designated by the numeral 34, the latter comprising a body 35 on which is mounted a pair of rollers 36 and a stop element 37. The cleaning arm 32 includes a body 33 from which extend an outer support portion 40 and an inner support portion 42, forming a slot 39 therebetween. A passage 29, that is threaded to mate with the threaded portion 30 of the shaft 18 of the positioning screw, extends through the body 33 of the cleaning arm 32, and a passage 29', that is threaded to mate with the screw portion 30', passes through the body 35 of the supporting arm 34.

Figure 4:
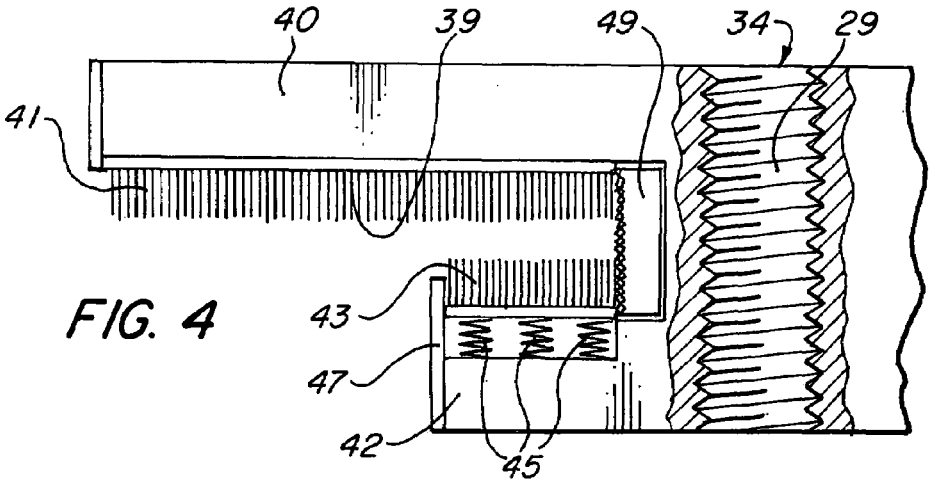
FIG. 4 is a fragmentary elevational view, drawn to an enlarged scale and also in partial section, showing a preferred form of the cleaning arm utilized in the tool of the invention.

The confronting faces of the arm portions 40, 42 carry removable brush elements 41 and 43, respectively. As can be seen in FIG. 4, the brush element 43 is biased away from the inner support portion 42 by a number of coil springs 45, and a suitable bracket 47 serves to maintain the brush element 43 in assembly while permitting it to move freely up and down. An abrasive fillet or strip 49, which may for example provide an array of file teeth, is removably secured on the body 33 at the end of the slot 39 formed between the support portions 40, 42.

Figure 2:
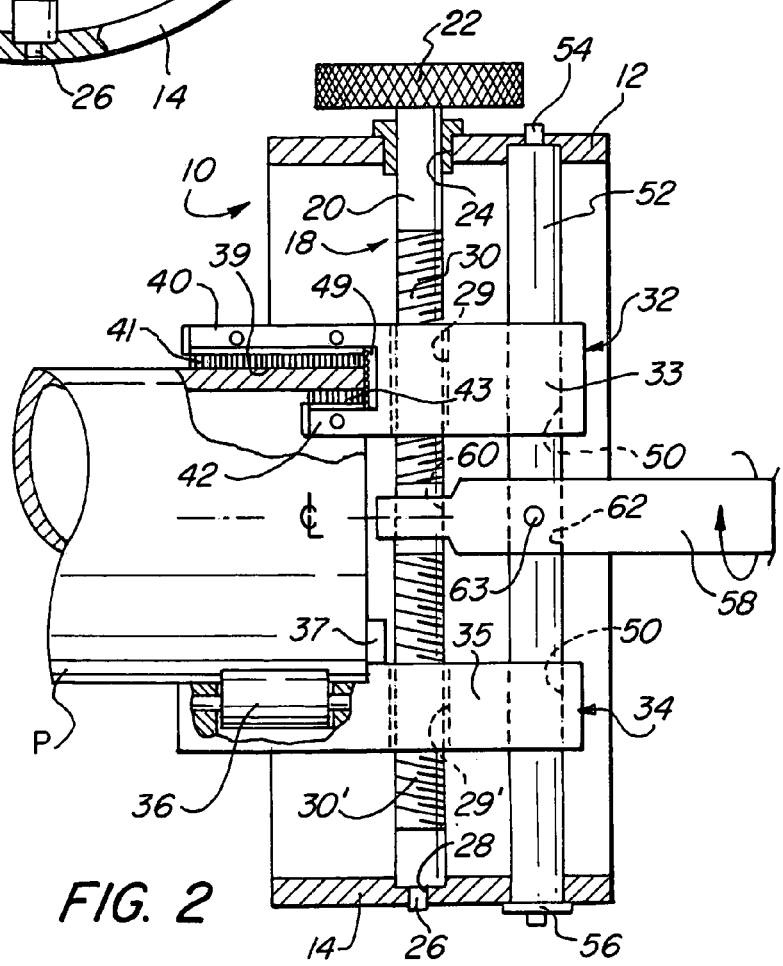
FIG. 2 is a view, in partial section, showing a tool of the invention constructed for semi-automatic operation.
Figure 3:
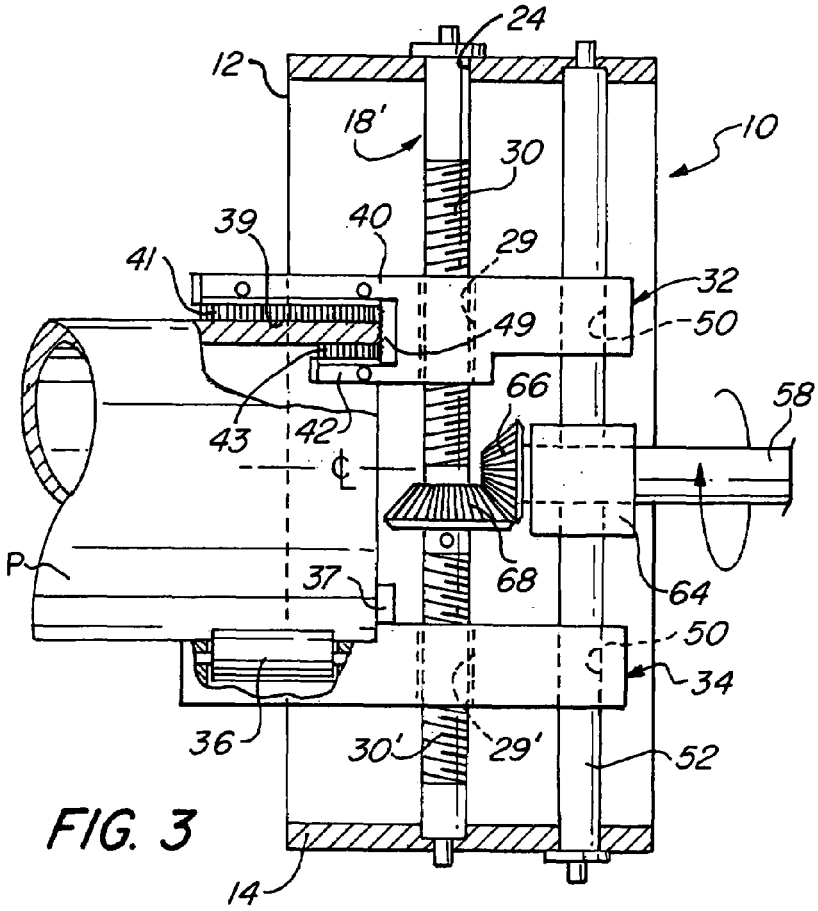
FIG. 3 is a view similar to FIG. 2 and showing a tool embodying the present invention, constructed for fully automatic operation.

As seen in FIGS. 2 and 3, a guide rod 52 extends transversely across the circular collar comprising the mounting head 10, behind and parallel to the positioning screw shaft 18 and with its opposite end portions 54 and 56 suitably attached the to collar sections 12, 14. The bodies 33 and 35 of the cleaning arm 32 and the pipe-supporting arm 34 have passages 50 through which the guide rod 52 extends, to slidably mount the arms and maintain them at operative altitudes within the cleaning tool.

The manner of use of the tool is self-evident. An open-end portion of a pipe P to be cleaned is inserted into the head 10 with its wall received in the slot 39 between the portions 40, 42 of the cleaning arm 32 and exteriorly supported upon the rollers 36 of the pipe-supporting arm 34. In that relationship the confronting brush elements 41, 43 bear intimately upon the outer and inner surfaces of the pipe P, with the (generally annular) end face of the pipe engaged by the stop element 37 on the body 35 of the pipe-supporting arm 34 and in contact with the abrasive fillet 49. In order to achieve that relationship (in the embodiments of FIGS. 1 and 2), the positioning screw is rotated manually, using the knurled knob 22, so as to cause the arms 32, 34 to move in opposite directions on the shaft 18 and thereby to engage the pipe P in the position described. Needless to say, subsequent rotation of the pipe and the head 10, relative to one another and about the axis of the pipe portion, will simultaneously effect cleaning of both the inside and outside surfaces of the pipe P, adjacent its open end, while also cleaning its annular end face.

The embodiment of FIG. 2 differs from that of FIG. 1 essentially in the provision of a drive shaft 58 through which both the positioning screw 18 and also the guide rod 52 extend, the drive shaft 58 having suitable passages 60, 62 through a forward end portion thereof for that purpose; the drive shaft 58 is staked to the guide rod 52 by a pin 63 so as to maintain the shaft 58 in a coaxial relationship to the head collar 12, 14. The rearward end of the power shaft 58 is constructed to facilitate gripping by the chuck of a suitable rotary machine (typically a hand-held power drill, but possibly a different kind of motorized machine or, indeed, a drill brace or other manually driven device). The cleaning arm and pipe-supporting arm in the cleaning tool of FIG. 2 are brought into engagement with a pipe by manual turning of the positioning screw, as hereinabove described. Thus, the tool is regarded to be of semiautomatic character (but of course, it could be rotated manually if so desired).

The embodiment depicted in FIG. 3 differs essentially from that of FIG. 2 in that the positioning screw, generally designated by the numeral 18', is coupled to the drive shaft so as to automate the closing action of the cleaning arm 32 and pipe-supporting arm 34, thus rendering the tool fully automatic. More particularly, a bevel gear 66 is attached to the forward end of the drive shaft 58, which meshes with a bevel gear 68 attached in a central location to the shaft 18' of the positioning screw. A guide sleeve or bushing 64 is attached to the guide rod 52, and serves to rotatably secure the drive shaft 58 in coaxial position relative to the mounting head collar 12, 14, and to secure the bevel gears 66, 68 in meshing interengagement.

In operation of the fully automatic embodiment of the cleaning tool, shown in FIG. 3, the pipe P would initially be positioned with its wall inserted into the slot 39 between the support portions 40, 42 of the cleaning arm 32 and with the pipe-supporting arm 34 spaced sufficiently from the cleaning arm 32 to accommodate the pipe P therebetween. Upon effecting rotation of the drive shaft 58 (affixed for example in the chuck of a power drill), the positioning screw shaft 18 would be caused to rotate, by operative engagement through the bevel gears 66, 68, so as to advance the pipe-supporting arm 34 and thereby bring the rollers 36 into contact with the outside surface of the pipe P. When further advance of the pipe-supporting arm 34 is retarded or arrested (by contact with the pipe), continued force upon the drive shaft 58 will cause the tool to rotate about the pipe P so as to effect the desired cleaning action. The inertia of the tool may alone be sufficient to ensure that the arm-closing action occurs before the tool itself is caused to rotate substantially; alternatively, a force could be applied to the head 10 so as to prevent or inhibit tool rotation until the closing action is substantially complete.

As indicated hereinabove, it is desirable to dimension the cleaning arm (or at least the inner support portion thereof) so as to ensure ready receipt within a pipe that is to be cleaned and to prevent interference with relative rotation. For the same reason it will usually be desirable to employ only a single cleaning arm, albeit the tool might incorporate a plurality of such arms in certain instances. Similarly, while a single pipe-supporting arm (or equivalent structure) will normally be sufficient and preferred, that will also not necessarily be the case. It will be appreciated that the use of a single cleaning arm and a single pipe-supporting arm affords additional fundamental advantages from the standpoint of simplifying construction and manufacture of the tool, particularly in respect of the complexity of the mechanism needed to effect adjustment of the positions of more than two, diametrically disposed arms.

As mentioned above, the cleaning elements will advantageously comprise brushes (e.g., of metal wire); elements of abrasive cloth or paper, steel wool or plastic scouring pads, and the like, may however be employed as well, in appropriate circumstances. The manner by which the cleaning and abrasive elements are attached to the respective support surfaces may of course also vary from the foregoing description. It is in any event desirable, however, that those elements be disengageably attached, so as to enable ready replacement when they become excessively worn or distorted; suitable attachment means may comprise for example mechanical fasteners, temporary bonding adhesives, Velcro-like components, or suitable retaining structures. The choice of cleaning and abrasive elements, and the manner of attachment, will be evident to those skilled in the art.

Thus, it can be seen that the present invention provides a tool for simultaneously cleaning inside and outside surfaces surrounding an open end portion of a pipe or other tubular conduit, which tool is adjustable so as to enable cleaning of pipes having diameters throughout a range of values. The tool may be constructed for manual use, for semi-automatic use, or for fully automatic use, and it may additionally be include an element for cleaning of the end face of a pipe simultaneously with the surrounding inside and outside surfaces.

What is claimed is:

1. A tool for simultaneously cleaning inside and outside surfaces surrounding an open end portion of a pipe, comprising: a mounting head; at least one cleaning arm having inner and outer support portions extending forwardly with respect to said mounting head and in parallel relationship to one another, said support portions having confronting faces thereon spaced transversely from one another and defining a rearwardly extending, forwardly open slot therebetween, each of said confronting faces having a pipe-cleaning element thereon; at least one pipe-supporting arm constructed to supportingly engage, from the outside, an end portion of a pipe; and means on said mounting head for mounting said one cleaning arm and said one pipe-supporting arm to extend forwardly with respect to said mounting head, in transversely spaced, fixedly parallel relationship to one another and in position to enable receipt, within said slot between said forwardly extending support portions of said one cleaning arm, of the wall of an open end portion of a pipe that is engaged and supported by said one pipe-supporting arm, said means for mounting enabling adjustment, along a rectilinear path, of the transverse spacing between said one cleaning arm and said one pipe-supporting arm; whereby relative rotation of said mounting head and a pipe, so engaged, supported and received, about the axis of the pipe end portion will cause said pipe-cleaning elements to effect simultaneous cleaning of the surrounding inside and outside surfaces of the pipe end portion.

2. The tool of claim 1 wherein said means for mounting comprises a rectilinear positioning screw rotatably mounted transversely in said mounting head, and wherein at least one of said one cleaning arm and said one pipe-supporting arm has a threaded transverse passage though which said positioning screw extends, said transverse passage being internally threaded to matingly engage at least a first threaded section of said positioning screw, whereby rotation of said positioning screw effects adjustment of the transverse spacing between said one cleaning arm and said one pipe-supporting arm.

3. The tool of claim 1 wherein said pipe-cleaning elements on both of said confronting faces are brushes.

4. The tool of claim 1 wherein at least said inner support portion of said one cleaning arm has a widest dimension that is not in excess of about one-half inch, so as to facilitate insertion of said inner support portion of said cleaning arm into pipes of small diameter and to avoid interference with relative rotation of the pipe and the mounting head of the tool.

5. The tool of claim 1 wherein elastically deformable means is provided for urging said pipe-cleaning element on said confronting face of said inner support portion of said one cleaning arm toward said outer support portion thereof.

6. The tool of claim 1 wherein said one cleaning arm has a support surface extending transversely across the rearward end of said slot between said mutually confronting faces and additionally includes a pipe end-cleaning element on said rearward end support surface.

7. The tool of claim 6 wherein pipe end-cleaning element is an abrasive element.

8. The tool of claim 1 wherein low-friction means is provided on said one pipe-supporting arm for so engaging the pipe end portion.

9. The tool of claim 8 wherein said low-friction means comprises at least one roller.

10. The tool of claim 1 further including a stop element on said one pipe-supporting arm, said stop element being spaced rearwardly from a free forward end of said pipe-supporting arm and being disposed to engage the end face of a pipe supported thereby so as to limit the depth of insertion of the pipe into said mounting head of said tool.

11. The tool of claim 1 additionally including a drive shaft operatively connected to said mounting head for effecting rotation thereof, and constructed for operative engagement with rotary drive means.

12. The tool of claim 11 wherein said means for mounting comprises a rectilinear positioning screw rotatably mounted transversely in said mounting head; wherein at least one of said one cleaning arm and said one pipe-supporting arm has a threaded transverse passage through which said positioning screw extends, said transverse passage being internally threaded to matingly engage a threaded portion of said positioning screw such that rotation of said positioning screw effects adjustment of the transverse spacing between said one cleaning arm and said one pipe-supporting arm; and wherein said drive shaft is also operatively connected for effecting rotation of said positioning screw for adjustment of said transverse spacing between said one cleaning arm and said one pipe-supporting arm.

13. The tool of claim 1 wherein said pipe-cleaning elements on both of said confronting surfaces are abrasive elements.

14. A tool for simultaneously cleaning inside and outside surfaces surrounding an open end portion of a pipe, comprising: a mounting head; at least one cleaning arm having inner and outer support portions extending forwardly with respect to said mounting head, said support portions having confronting faces thereon spaced transversely from one another and defining a rearwardly extending, forwardly open slot therebetween, each of said confronting faces having a pipe-cleaning element thereon; at least one pipe-supporting arm constructed to supportingly engage, from the outside, an end portion of a pipe; and means on said mounting head for mounting said one cleaning arm and said one pipe-supporting arm to extend forwardly with respect to said mounting head, in transversely spaced relationship to one another and in position to enable receipt, within said slot between said forwardly extending support portions of said one cleaning arm, of the wall of an open end portion of a pipe that is engaged and supported by said one pipe-supporting arm, said means for mounting enabling adjustment of the transverse spacing between said one cleaning arm and said one pipe-supporting arm and comprising a rectilinear positioning screw rotatably mounted transversely in said mounting head, at least one of said one cleaning arm and said one pipe-supporting arm having a threaded transverse passage though which said positioning screw extends, and said transverse passage being internally threaded to matingly engage at least a first threaded section of said positioning screw such that rotation of said positioning screw effects adjustment of the transverse spacing between said one cleaning arm and said one pipe-supporting arm; whereby relative rotation of said mounting head and a pipe, so engaged, supported and received, about the axis of the pipe end portion will cause said pipe-cleaning elements to effect simultaneous cleaning of the surrounding inside and outside surfaces of the pipe end portion.

15. The tool of claim 14 wherein said positioning screw has a second threaded section thereon with a thread direction that is opposite to the thread direction of said first threaded section; and wherein each of said one cleaning arm and said one pipe-supporting arm has a said threaded transverse passage that receives therethrough, and is internally threaded to matingly engage with, one or the other of said first and second threaded sections of said positioning screw, whereby rotation of said positioning screw causes said one cleaning arm and said one pipe-supporting arm to move simultaneously in opposite directions.

16. The tool of claim 14 wherein said means for mounting includes manual turning means for enabling manual rotation of said positioning screw.

17. The tool of claim 14 wherein said mounting head is generally circular, and wherein said positioning screw extends diametrically across said mounting head.

18. The tool of claim 17 wherein said mounting means additionally includes a rectilinear guide rod mounted transversely in said mounting head, parallel to and rearwardly of said positioning screw, said at least one of said one cleaning arm and said one pipe-supporting arm having a transverse passage through which said guide rod extends for slidable support of said at least one of said one cleaning arm and said one pipe-supporting arm on said guide rod.

19. A tool for simultaneously cleaning inside and outside surfaces surrounding an open end portion of a pipe, comprising: a mounting head; at least one cleaning arm having inner and outer support portions extending forwardly with respect to said mounting head, said support portions having confronting faces thereon spaced transversely from one another and defining a rearwardly extending, forwardly open slot therebetween, each of said confronting faces having a pipe-cleaning element thereon; at least one pipe-supporting arm constructed to supportingly engage, from the outside, an end portion of a pipe, said pipe-supporting arm having at least one roller thereon for so engaging the pipe end portion; and means on said mounting head for mounting said one cleaning arm and said one pipe-supporting arm to extend forwardly with respect to said mounting head, in transversely spaced relationship to one another and in position to enable receipt, within said slot between said forwardly extending support portions of said one cleaning arm, of the wall of an open end portion of a pipe that is engaged and supported by said one pipe-supporting arm, said means for mounting enabling adjustment of the transverse spacing between said one cleaning arm and said one pipe-supporting arm; whereby relative rotation of said mounting head and a pipe, so engaged, supported and received, about the axis of the pipe end portion will cause said pipe-cleaning elements to effect simultaneous cleaning of the surrounding inside and outside surfaces of the pipe end portion.

* * * * *